United States Patent [19]

Merino Ciudad

[11] Patent Number: 4,811,497

[45] Date of Patent: Mar. 14, 1989

[54] SPORT SHOE

[76] Inventor: Ana I. Merino Ciudad, Carretera de Sax No. 10, Elda (Alicante), Spain

[21] Appl. No.: 166,453

[22] Filed: Mar. 10, 1988

[30] Foreign Application Priority Data

Mar. 18, 1987 [ES] Spain ..... 8700922

[51] Int. Cl.[4] ..... A43B 11/00; A43B 5/00; A43B 5/02

[52] U.S. Cl. ..... 36/51; 36/114; 36/128

[58] Field of Search ..... 36/51, 128, 114, 54, 36/133

[56] References Cited

U.S. PATENT DOCUMENTS

| | | | |
|---|---|---|---|
| 1,940,542 | 12/1933 | Goth | 36/51 |
| 2,656,620 | 10/1953 | Taylor | 36/51 X |
| 3,650,051 | 3/1972 | Sass | 36/128 X |
| 4,616,432 | 10/1986 | Bunch et al. | 36/114 X |

FOREIGN PATENT DOCUMENTS

| | | | |
|---|---|---|---|
| 0184996 | 6/1986 | European Pat. Off. | 36/128 |
| 928996 | 6/1955 | Fed. Rep. of Germany | 36/128 |
| 2438554 | 2/1975 | Fed. Rep. of Germany | 36/114 |
| 3314274 | 10/1983 | Fed. Rep. of Germany | 36/128 |
| 1016554 | 1/1966 | United Kingdom | 36/51 |

*Primary Examiner*—James Kee Chi
*Attorney, Agent, or Firm*—Robbins & Laramie

[57] ABSTRACT

Sport shoe having a central cut of material in the vamp section, from the vicinity of the toe to the top of the vamp which has a series of strips that remain connected to each other in a standard section of elastic material connected to these by means of a sewing, while being able to separate from each other when required to do so upon putting on or taking off the shoe.

1 Claim, 1 Drawing Sheet

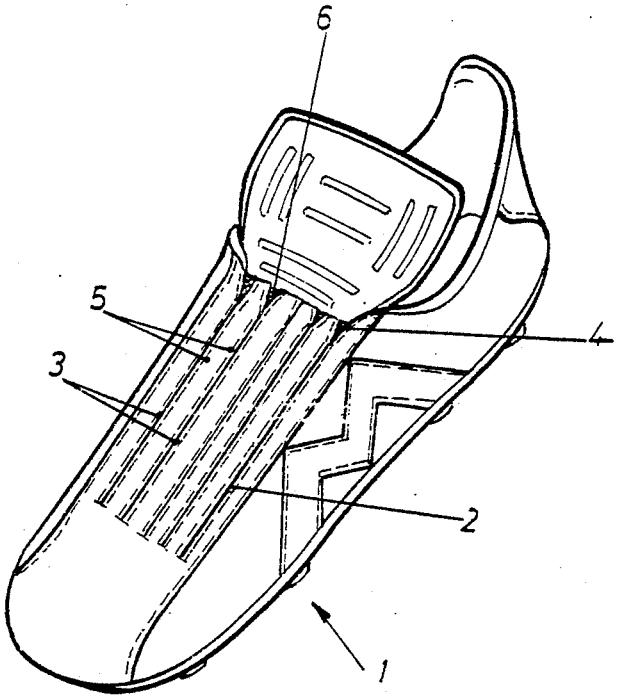
6
5
4
3
2
1

SPORT SHOE

The present invention refers to a sport shoe.

Said sport shoe is preferably a soccer shoe or boot although, through extention, it can also be any other shoe used for sports.

Soccer shoes or boots have to comply with basic and fundamental characteristics, not only to allow a player to feel comfortable with them but also in order that the boot's configuration should give the optimum results when playing soccer.

These and other basic characteristics are found in the sport shoe of this invention, which also presents the following advantages over, for example, existing soccer boots:

Ease in putting on and taking off the boots, since these do not have laces (strings).

Since the boot does not have any laces, the top (vamp) section of the boot is absolutely plain, thus being able to direct the ball more accurately as the contact zone is plain.

In accordance with the invention, the sport shoe, preferably a soccer boot, has a configuration in its upper (vamp) section and on the inside consisting of an elastic central sewn section, the effects of which are further enhanced by longitudinal parallel cuts in the section.

The above mentioned configuration results in an elastic deformation of the vamp section which facilitates puting on and taking off the boot.

Additionally, and as already mentioned before, the vamp section of the boot is totally plain because of the fact that the boot does not have any laces.

This plain section of the boot's vamp permits the player, upon kicking the ball, to perfectly direct the trajectory of said ball as the shoe or boot, contrary to traditional boots, does not have any protuberances resulting from the tying of the shoe laces.

The shoe or boot can additionally have, on the sides, centrally disposed, some sown on parts simulating a letter; these sown-on sections are not a characteristic to be protected as part of the invention.

With the object of an easier comprehension not on only of the construction of the boot, but also its use and advantages of the invention, following is a description of a sample of the invention, this being simply an example of one of the possible variants of the sport shoe considered as this invention: the sample boot under consideration is show as a perspective view of a soccer boot 1 with a raised or vamp section 2 which is absolutely plain, having a series of strait and parallel cuts 3 connected to an inner elastic surface 4 by means of sewing lines 5.

The elastic surface has a reinforcing section 6 of the same material at the top of the vamp part of the boot, thus assuring that the vamp section of the boot closes firmly over the foot of the player.

The strait and parallel cuts 3 run the whole length of the vamp, and are part of a whole section of material that runs from the toe of the shoe to top of the vamp, said section being conveniently sown on the remaining part of the shoe.

The invention being thus described, it will be obvious that the same may be varied in many ways. Such variantions are not to be regarded as a departure from the spirit of scope of the invention and all such modifications are intended to be included within the scope of the claims.

I claim:

1. Sport shoe, such as a soccer boot characterized in that the cut of material corresponding to the vamp section of the boot is totally plain and has a series of cuts which extend from the top of the vamp towards the toe, these being parallel and close to each other, and connected by sewing lines to an inner elastic and flexible section which facilitates putting on and taking off of the boot or shoe.

* * * * *